US006822528B2

(12) United States Patent
Dawn et al.

(10) Patent No.: US 6,822,528 B2
(45) Date of Patent: Nov. 23, 2004

(54) TRANSMISSION LINE TO WAVEGUIDE TRANSITION INCLUDING ANTENNA PATCH AND GROUND RING

(75) Inventors: Debasis Dawn, San Jose, CA (US); Edmar Camargo, San Jose, CA (US); Yoji Ohashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/976,569

(22) Filed: Oct. 11, 2001

(65) Prior Publication Data

US 2003/0076188 A1 Apr. 24, 2003

(51) Int. Cl.[7] ..... H01P 5/107
(52) U.S. Cl. ..... 333/26; 333/33
(58) Field of Search ..... 333/26, 33

(56) References Cited

U.S. PATENT DOCUMENTS 5,585,768 A * 12/1996 Wei ..... 333/26

FOREIGN PATENT DOCUMENTS

| | | | | |
|---|---|---|---|---|
| EP | 1014471 A | | 6/2000 | ..... H01P/5/107 |
| FR | 2462787 | * | 3/1981 | ..... 333/26 |
| JP | 08-139504 A | | 11/1994 | ..... H01P/5/107 |

OTHER PUBLICATIONS

W. Grabherr, B. Huder, and W. Menzel, "Microstrip to waveguide Transition compatible with mm–wave integrated circuits", *IEEE Trans. Microwave Theory Tech.*, vol. 42, pp 1842–1843, Sep. 1994.

L. Hyvonen and A. Hujanen, "A compact mmic–compatible microstrip to waveguide transition", in *IEEE MTT–S Int. Symp. Dig.*, pp 875–878, 1996.

F. J. Villegas, D. I. Stones, and H. A. Hung, "A novel waveguide to microstrip transition for millimeter–wave module applications", *IEEE Trans. Microwave Theory Tech.*, vol. 47, pp 48–55, Jan. 1999.

I. Gresham, N. Jain, T. Budka, A. Alexanian, N. Kinayman, B. Ziegner, S. Brown, and P. Staecker "A 76–77GHz pulsed Doppler radar module for autonomous cruise control applications", In *IEEE MTT–S Int. Symp. Dig.*, pp 1551–1554, 2000.

N. Jain and N. Kinayman, "A novel microstrip mode to waveguide mode transformer and its application", In *IEEE MTT–S Int. Symp. Dig.*, pp 623–626, 2001.

T. Shimura and Y. Ohashi, "A single–chip transceiver module for 76–GHz automotive radar sensors", *31st European Microwave Conference Proceedings*, vol. 3, pp 153–156, Sep. 2001.

* cited by examiner

*Primary Examiner*—Benny Lee
(74) *Attorney, Agent, or Firm*—Sheppard Mullin Richter & Hampton LLP

(57) ABSTRACT

Disclosed are planar structures for coupling electromagnetic signals between planar transmission lines and waveguides. A preferred exemplary structure comprises a shielded patch antenna and one or more capacitive diaphragms disposed adjacent to the patch antenna. This structure is advantageous to MMIC modules in connecting from a planar transmission line of a substrate carrying an MMIC to an external waveguide without the need of a non-planar back metal short, which is normally essential to avoid back scattering from the waveguide and also normally needed to achieve impedance matching. In structures according to the present invention, a patch antenna radiates into the waveguide while the antenna's ground plane reduces back scattering from the waveguide. The one or more capacitive diaphragms provide impedance matching between the microstrip and the waveguide.

21 Claims, 5 Drawing Sheets

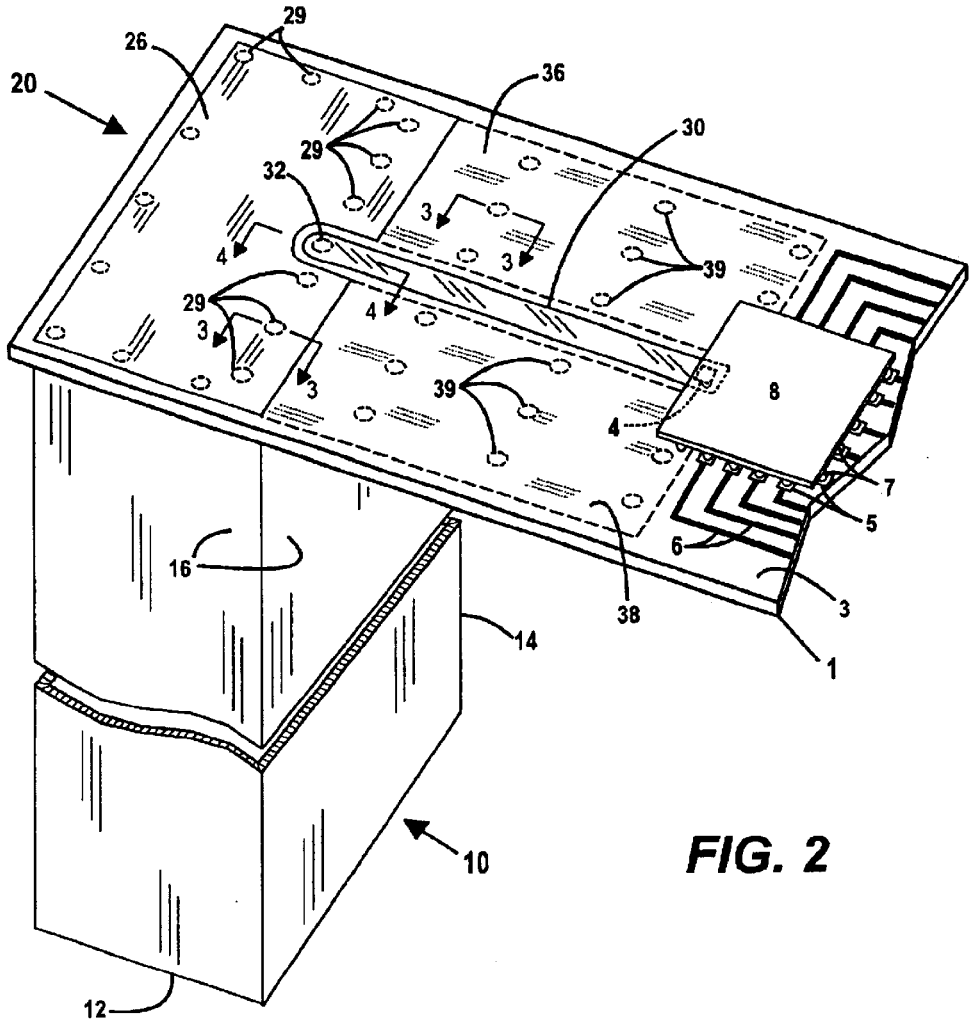
FIG. 2
FIG. 3
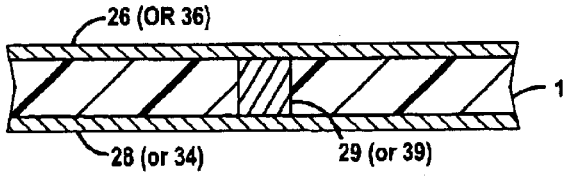
FIG. 4
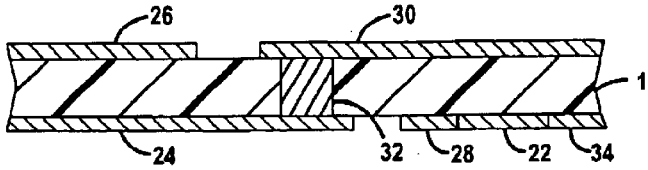

TRANSMISSION LINE TO WAVEGUIDE TRANSITION INCLUDING ANTENNA PATCH AND GROUND RING

FIELD OF THE INVENTION

The present invention relates to coupling structures which convert electrical signals from one transmission medium to another, and more particularly to coupling structures which convert electrical signals from planar transmission lines to waveguides.

BACKGROUND OF THE INVENTION

As is known in the art, electrical signals may be conveyed by a number of transmission mediums, including electrical traces on circuit boards (e.g., transmission lines), waveguides, and free-space. In many applications, one or more electrical signals are converted from one transmission medium to another. Structures which convert signals from one medium to another are called coupling structures. Such structures for coupling from circuit board traces to waveguides have become increasingly popular due to their growing applications in the area of low-cost packages for monolithic microwave integrated circuits (MMICs), particularly for MMICs which process signals in the millimeter-wave frequency bands.

In most of the prior art circuit-board to waveguide coupling structures, a metal cavity or a metal short on a different plane is used to achieve impedance matching to the waveguide and to avoid back scattering from the waveguide. In some cases, the distance of the back metal short from the planar circuit sets the frequency of operation, which is not always desirable. Instead of using a back metal short, other prior art structures use a quarter-wavelength long dielectric slab inserted into the waveguide to achieve better impedance matching. Such a dielectric slab can have a metal patch disposed on one of its surfaces, or it may be left blank. For these dielectric-slab embodiments, package costs become quite high due to the difficulties in the mechanical fitting and alignment of the dielectric slab inside the waveguide wall.

In view of the prior art, there is a need for a planar transmission line to waveguide coupling structure which does not impose constraints on the frequency of operation, and which is relatively inexpensive to manufacture. The present invention is directed to filling such a need.

SUMMARY OF THE INVENTION

In making their invention, the inventors have recognized that to keep the overall package costs to a minimum, it is desirable to design a coupling structure which is mechanically simple and easy to attach to the housing of the waveguide. As part of their invention, the inventors have developed a structure that may be integrated onto a selected portion of a substrate which carries the electrical signal, and that may be coupled to the waveguide by attaching the selected portion of the substrate to an end of the waveguide. The substrate may comprise a printed circuit board, a multichip substrate, or the like. Constructions according to the present invention may be integrated on the same substrate which carries the chip that generates the electrical signal being coupled to the waveguide. Since constructions according to the present invention may be integrated onto an existing substrate that can be constructed with mature and cost-efficient manufacturing processes, the present invention is relatively inexpensive to practice.

The present invention encompasses coupling structures for coupling an electrical signal on a substrate to a waveguide. The substrate has a substrate layer with a first major surface and a second major surface opposite to the first major surface, and the waveguide has a first end, a second end, and a housing disposed between the first and second ends. The substrate layer may comprise a single layer of dielectric material, or may comprise a plurality of dielectric sub-layers and conductive (e.g., metal) sub-layers interleaved with respect to one another. The waveguide housing defines a longitudinal dimension between the first and second ends along which electromagnetic waves may propagate. The waveguide housing has one or more walls which form a lip at one waveguide end, to which constructions according to the present invention may be attached.

An exemplary structure according to the present invention comprises a ground ring located on the first major surface of the substrate layer and adapted for contact with the lip at an end of a waveguide, a first area enclosed by the ground ring, and a ground plane disposed on the second major surface of the substrate layer and located opposite to at least the first area. The exemplary structure further comprises a patch antenna disposed on the first major surface of the substrate layer or within the substrate layer (as may be the case when the substrate layer comprises sub-layers), and further located within the first area. The electrical signal is coupled to the patch antenna, such as by an electrical trace that is conductively isolated from the ground ring and the ground plane.

In preferred embodiments according to the present invention, the electrical signal is conveyed to the patch antenna by a conductive trace disposed on the second major surface of the substrate layer or within the substrate layer (as may be the case when the substrate layer comprises sub-layers), and a conductive via formed in the substrate layer, and preferably through the substrate layer between the first and second major surfaces. The conductive via is electrically coupled to the patch antenna and to the conductive trace.

Preferred embodiments of the present invention further comprise a capacitive diaphragm disposed on the substrate layer's first major surface or within the substrate layer (as may be the case when the substrate layer comprises sub-layers), and further located between the patch antenna and the ground ring. The capacitive diaphragm enables a better matching of the impedance of the conductive trace to the impedance of the waveguide, and thus enables the constructions according to the present invention to operate over a wide range of frequency.

Accordingly, it is an object of the present invention to provide coupling structures for coupling an electrical signal on a substrate to a waveguide which are inexpensive to construct.

It is another object of the present invention to provide such coupling structures which are compact in size and which can be easily coupled to a waveguide.

It is yet another object of the present invention to provide such coupling structures which are simple in construction and which can be readily mass produced.

It is still another object of the present invention to provide such a coupling structure which can have its operating frequency set to any value over a wide range of frequencies with the addition of a simple and compact component.

It is a further object of the present invention to minimize the packaging costs of MMICs which have output signals coupled to waveguides and/or input signals which are received from waveguides.

It is yet another object of the present invention to provide a substrate-to-waveguide coupling structure which does not require structural modifications to the waveguide.

These and other objects of the present invention will become apparent to those of ordinary skill in the art upon review of the present Specification and the attached claims.

BRIEF DESCRIPTION OF THE DRAWINGS

FIG. 2 shows a perspective view of an exemplary coupling structure according to the present invention coupled to an end of a waveguide.

FIGS. 3 and 4 are cross-sectional views of vias used in exemplary coupling structures according to the present invention.

DETAILED DESCRIPTION OF THE INVENTION

Figure 1:
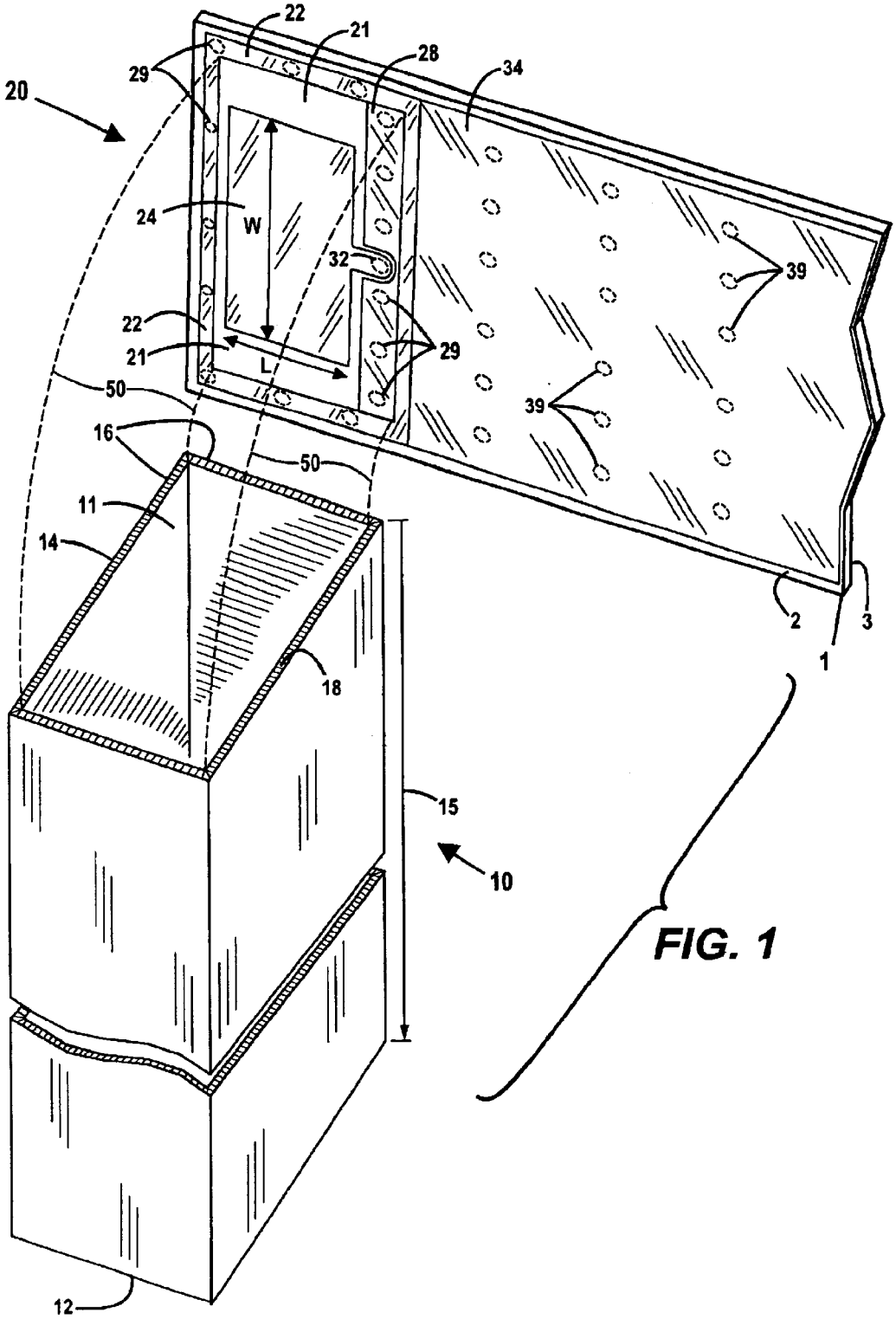
FIG. 1 shows a perspective view of an exemplary coupling structure according to the present invention separated from an end of a waveguide.

FIG. 1 shows a perspective view of an exemplary coupling structure 20 formed on a substrate layer 1 according to the present invention. Substrate layer 1 may comprise a single sub-layer of material, which is usually a dielectric material, or may comprise a plurality of sub-layers of dielectric material and patterned sub-layers of conductive material. To simplify the presentation of the present invention, a single dielectric sub-layer for substrate layer 1 is shown in FIGS. 1–5. Coupling structure 20 is adapted to be coupled to a waveguide 10 at a first end 11 of waveguide 10, as shown by the dashed lines 50 in the figure. Waveguide 10 also has a second end 12 and a housing 14 disposed between first end 11 and second end 12. Housing 14 has one or more walls 16, and defines a longitudinal dimension 15 between first end 11 and second end 12 along which electromagnetic waves may propagate. Four walls are shown in this exemplary embodiment, but a different number may be used, such as one wall for cylindrical waveguides and conical waveguides, and such as twelve walls for ridge waveguides. In all cases, the one or more walls 16 form a lip 18 at first end 11 to which coupling structure 20 may be attached, as described below. electromagnetic waves may propagate. Four walls are shown in this exemplary embodiment, but a different number may be used, such as one wall for cylindrical waveguides and conical waveguides, and such as twelve walls for ridge waveguides. In all cases, the one or more walls 16 form a lip 18 at first end 11 to which coupling structure 20 may be attached, as described below.

An embodiment of the present invention is constructed on a portion of substrate layer 1, the latter of which may be a printed-circuit board, a multichip substrate, or the like. Substrate layer 1 has two major surfaces 2 and 3, which we will call the bottom major surface 2 and top major surface 3 without loss of generality. Substrate 1 may comprise a single sheet of uniform material, or may comprise multiple laminated sheets (called "sub-layers") made from two or more different materials, such as a set of dielectric sub-layers with intermixed conductive sub-layers, all laminated together. Coupling structure 20 comprises a ground ring 22 which is located on bottom major surface 2 and which is adapted (e.g., has the shape and dimensions) for contact with lip 18 at the waveguide's first end 11. Ground ring 22 encloses a first area 21 and comprises an electrically conductive material, such as metal, metal alloy, or a laminated structure of metal and/or metal alloy. Substrate layer 1 comprises a substantially less conductive material, and preferably comprises a dielectric material which is substantially electrically isolating. In its most basic form, ground ring 22 comprises a closed-loop strip of conductive material which has a shape that conforms to the mirror image of the waveguide's lip 18.

Coupling structure 20 further comprises a patch antenna 24 disposed on bottom major surface 2 or within the substrate layer (as may be the case when the substrate layer comprises sub-layers), and further located within first area 21. Patch antenna 24 is physically separated, and conductively isolated, from ground ring 22. In its most basic form, patch antenna 24 comprises a pad of an electrically conductive material, and may comprise the same conductive material as ground ring 22. Patch antenna preferably comprises the shape of a rectangle which has a width W along the longer cross-sectional dimension of the waveguide and a length L along the shorter cross-sectional dimension of the waveguide. However, other shapes are possible, and the dimensions thereof may be determined through the use of a three-dimensional (3-D) electromagnetic wave simulation program, such as many of the simulation products available from Ansoft Corporation, Bay Technology, Sonnet Software, Inc., and similar companies. In the present simulation, the High Frequency Structure Simulator software initially manufactured by Hewlett-Packard and subsequently by Agilent Technologies (and now sold by Ansoft Corporation) has been used. As described below in greater detail, the electrical signal which is to be coupled to the waveguide is electrically coupled to patch antenna 24, which in turn excites the desired propagation modes within the waveguide (which are usually $TE_{mn}$ modes).

Preferred embodiments of coupling structure 20 further comprise one or more capacitive diaphragms 28 which improve the electromagnetic impedance matching between patch antenna 24 and waveguide 10. One capacitive diaphragm has been shown in FIGS. 1–2. In its most basic form, a capacitive diaphragm 28 comprises a pad of an electrically conductive material disposed within first area 21 and electrically isolated from patch antenna 24, and may comprise the same material as ground ring 22 and/or patch antenna 24. Each capacitive diaphragm is located on bottom major surface 2 or within the substrate layer (as may be the case when the substrate layer comprises sub-layers). A capacitive diaphragm 28 is preferably maintained at a constant potential. It may be electrically coupled to ground ring 22 and/or a ground plane, or it may be fed with a separate potential which is different from ground (in which case it is conductively isolated from ground ring 22). In preferred embodiments of the present invention, at least one capacitive diaphragm 28 and ground ring 22 are electrically coupled together and are integrally formed together with the same material, which provides for a more compact construction of coupling structure. In this preferred implementation, the capacitive diaphragm 28 may contact (i.e., abut against) one or more of the sides of ground ring 22, or may be offset from the inner side(s) of ground ring 22 as long as it is electrically coupled (e.g., conductively coupled) to ground ring 22.

In preferred practice of the present invention, a ground plane 34 is included on bottom major surface 2 of substrate layer 1 to aid in constructing impedance-controlled transmission lines on top major surface 3. As described below in greater detail, preferred embodiments may also include conductive vias 29 for electrically coupling capacitive diaphragm, and may include conductive vias 39 for electrically coupling ground plane 34 to other ground planes (not shown in FIG. 1) that are hidden behind ground plane 34. Conductive vias 29 and 39 are shown in FIG. 1 by dashed lines.

FIG. 2 shows the same perspective view of FIG. 1, but with substrate layer 1 and exemplary coupling structure 20 rotated and moved down to make contact with the first end 11 (not depicted in FIG. 2) of waveguide 10. In this configuration, the lip 18 of waveguide 10 fits onto ground ring 22 (not depicted in FIG. 2.), , which preferably has a shape which is substantially a mirror image of the shape of lip 18, but preferably with a wider width. Lip 18 may be adhered to ground ring 22 with solder, electrically conductive adhesive, or a metal diffusion bond or the like. Preferably, all of the walls 16 of the waveguide are electrically coupled to ground ring 22 at lip 18. Housing 14 and second end 12 of waveguide 10, which were previously described with respect to FIG. 1, are shown by the same reference numbers in FIG. 2.

The basic construction of coupling structure 20 further comprises a ground plane 26 disposed on top major surface 3 and over an area of surface 3 which is opposite to at least first area 21. In its most basic form, ground plane 26 comprises a layer of conductive material disposed within this area. In preferred embodiments of coupling structure 20, ground plane 26 is further disposed over an area of surface 3 which overlies ground ring 22. Ground plane 26 aids in the operation of patch antenna 24 by providing the antenna with an opposing grounding surface, and further reduces transmission (e.g., back scattering) of electromagnetic waves from first end 11 of waveguide 10 by providing a conductive shield. When capacitive diaphragm 28 (see FIG. 1) is employed, it is preferably coupled to ground plane 26 by one or more conductive vias 29 formed in or through substrate layer 1 and between its major surfaces 2 and 3. The positions of vias 29 are outlined by dashed lines in FIGS. 1 and 2, and an exemplary one is shown in cross-sectional view by FIG. 3. As seen in FIG. 3, ground plane 26 and capacitive diaphragm 28 are disposed on opposite surfaces of substrate 1, and via 29 is disposed through substrate 1 and between ground plane 26 and capacitive diaphragm 28. As described below in greater detail, FIG. 3 also shows the same structure for a via 39 coupled between ground plane 34 and another ground plane 36, with ground planes 34 and 36 being disposed on opposite surfaces of substrate 1, and with the reference numbers 34, 36, and 39 shown within parentheses.

As thus far described, the basic construction of coupling structure 20 comprises ground ring 22, first area 21, patch antenna 24, and ground plane 26, and covers the portion of substrate layer 1 which is spanned by ground ring 22. Further embodiments of coupling structure 20 comprise capacitive diaphragm 28 if an improvement in electromagnetic impedance matching is desired or needed. The portion of substrate layer 1 not covered by these components may be configured by the particular application which utilizes the present invention. In FIG. 2, we have shown the exemplary application of a monolithic microwave integrated circuit (MMIC) 8 which utilizes coupling structure 20 to couple its electrical signal 4 to waveguide 10. MMIC 8 is fed with power, ground, and a plurality of low-frequency signals by a plurality of electrical traces 6 disposed on top major surface 3 of substrate layer 1. Traces 6 are coupled to a plurality of pads disposed on a surface of MMIC 8 by way of a plurality of pads 5 disposed on surface 3 of substrate layer 1 and by the way of solder bumps 7 disposed between pads 6 and the corresponding pads on MMIC 8.

Because of the perspective angle used in FIG. 2, the output pad on MMIC 8 for signal 4 cannot be directly seen, but is shown in outline by dashed lines in FIG. 2. The pad for signal 4 is coupled to a high-frequency trace 30 by a respective solder bump 7. Trace 30 conveys electrical signal 4 to coupling structure 20, where it is coupled to patch antenna 24 by way of a conductive via 32. The position of via 32 is outlined by dashed lines in FIGS. 1 and 2, and is shown in cross-sectional view by FIG. 4. FIG. 4 shows ground plane 26 and electrical trace 30 disposed on the top major surface of substrate 1; shows patch antenna 24, capacitive diaphragm 28, ground ring 22, and ground plane 34 disposed on the bottom major surface of substrate 1; and shows a via 32 disposed through substrate 1 and electrically coupled to trace 30 and patch 24. Electrical trace 30 is preferably configured as a planar transmission line, and more preferably as a microstrip line or a coplanar waveguide line. Instead of microstrip line or coplanar waveguide line, preferred implementations of trace 30 may be configured as slot-lines, coplanar strips, and symmetrical striplines, as well as other types of planar transmission lines. As is known in the art, a microstrip line comprises a conductive trace disposed on one surface of a substrate layer, and a conductive ground plane disposed on the opposite surface of the substrate layer and underlying the conductive trace. A microstrip configuration for the electrical trace 30 is shown in FIGS. 1 and 2 where the underlying ground plane is shown at reference number 34 in FIG. 1. A grounded coplanar waveguide line comprises the electrical trace and underlying ground plane of the microstrip structure (e.g., trace 30 and ground plane 34), plus additional ground planes on the top surface of the substrate layer, and disposed on either side of the electrical trace. The additional ground planes are shown in dashed lines at reference numbers 36 and 38 in FIGS. 2 and 3. The additional ground planes 36 and 38 are preferably electrically coupled to the underlying ground plane 34 by a plurality of electrically conductive vias 39. Each location of a via 39 is outlined by a dashed circle in FIGS. 1 and 2, and an exemplary one is shown in cross-sectional view by FIG. 3. As seen in FIG. 3 with the reference numbers shown within parentheses, ground planes 34 and 36 are disposed on opposite surfaces of substrate 1, and via 39 is disposed through substrate 1 and between ground planes 34 and 36. In addition, conductive trace 30 and ground planes 34, 36 and 38 may be formed within substrate layer 1 if substrate layer 1 comprises multiple interleaving sub-layers of dielectric material and patterned conductive material.

If ground plane 34 is used, it may be physically connected and electrically coupled to the adjacent side of ground ring 22, and both may comprise the same conductive material.

In addition to a grounded coplanar waveguide, a simple (ungrounded) coplanar waveguide line may be used. A coplanar waveguide line comprises the electrical trace (e.g, trace 30) and additional ground planes on the top surface of the substrate layer (e.g., ground plane 38). The underlying ground plane 34 and conductive vias 39 in FIG. 2 are not used with the simple coplanar waveguide line.

As is well known in the art, the following factors influence the characteristic impedance of trace 30: the dielectric constant and thickness of substrate layer 1, the strip width of trace 30, and the distance of the gap between trace 30 and each of additional ground planes 36 and 38 (if present). One usually has a desired characteristic impedance in mind (usually 50 ohms), and usually has to work with a given substrate layer thickness and dielectric constant. Therefore, one usually varies the strip width of trace 30 and the gap between it and the top-side ground planes 36 and 38 (if present) to achieve the desired level of characteristic impedance. This selection task has been well analyzed in the art, and many college-level books on electromagnetic engineering contain tables and charts which relate the trace's strip width to the resulting level of characteristic impedance for a number of transmission line structures. Accordingly, the selection of strip width for trace 30 to achieve a desired level of characteristic impedance is within the ordinary skill of the art and no further explanation need be given here for one of ordinary skill in the art to make and use the present invention.

Figure 8:
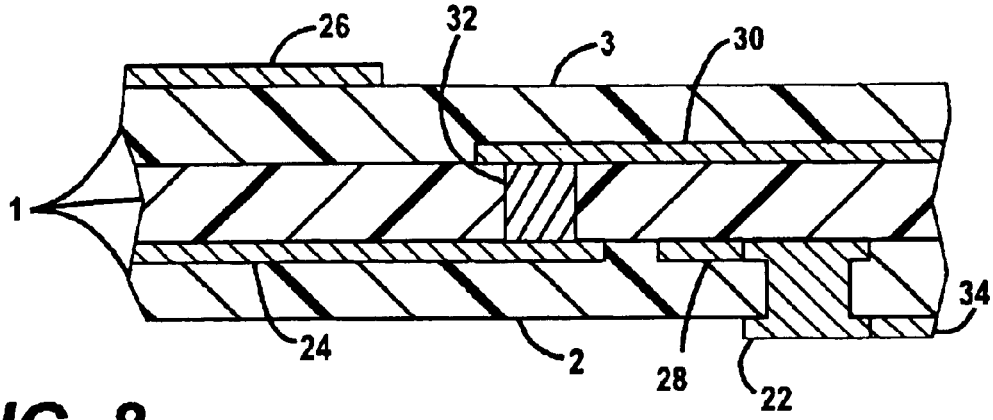
FIG. 8 is a partial cross-sectional view showing where the patch antenna, capacitive diaphragm, and feed trace are disposed within the substrate according to the present invention.

As indicated above, patch antenna 24, capacitive diaphragm 28, trace 30, and ground planes 34, 36, and 38 may be formed on patterned conductive sub-layers of substrate layer 1 when substrate layer 1 comprises a plurality of interleaving dielectric and conductive sub-layers. In such a case, these components are positioned within substrate layer 1 and between bottom major surface 2 and top major surface 3. In addition, a dielectric sub-layer may be laminated onto top major surface 3 and ground plane 26, and additional conductive and dielectric sub-layers may be laminated onto the first laminated dielectric sub-layer, if desired. It may be appreciated that in such a case, for the purposes of the claims of the application, the substrate layer 1 comprises the sub-layers between ground ring 22 and ground plane 26. An example of substrate 1 comprising sub-layers is illustrated in FIG. 8, where substrate layer 1 comprises three dielectric sub-layers disposed between bottom major surface 2 and top major surface 3. Patch antenna 24 and capacitive diaphragm 28 are disposed between the two lower dielectric sub-layers of substrate layer 1, whereas trace 30 is disposed between the two upper dielectric sub-layers of substrate layer 1. As in prior embodiments, conductive via 32 provides an electrical connection between patch antenna 24 and electrical trace 30; ground plane 26 is disposed on top major substrate 3; and ground plane 34 is disposed on bottom major substrate 2. Ground ring 22 is disposed at bottom major surface 2, and is electrically coupled to ground plane 34 and capacitive diaphragm 28.

Figure 5:
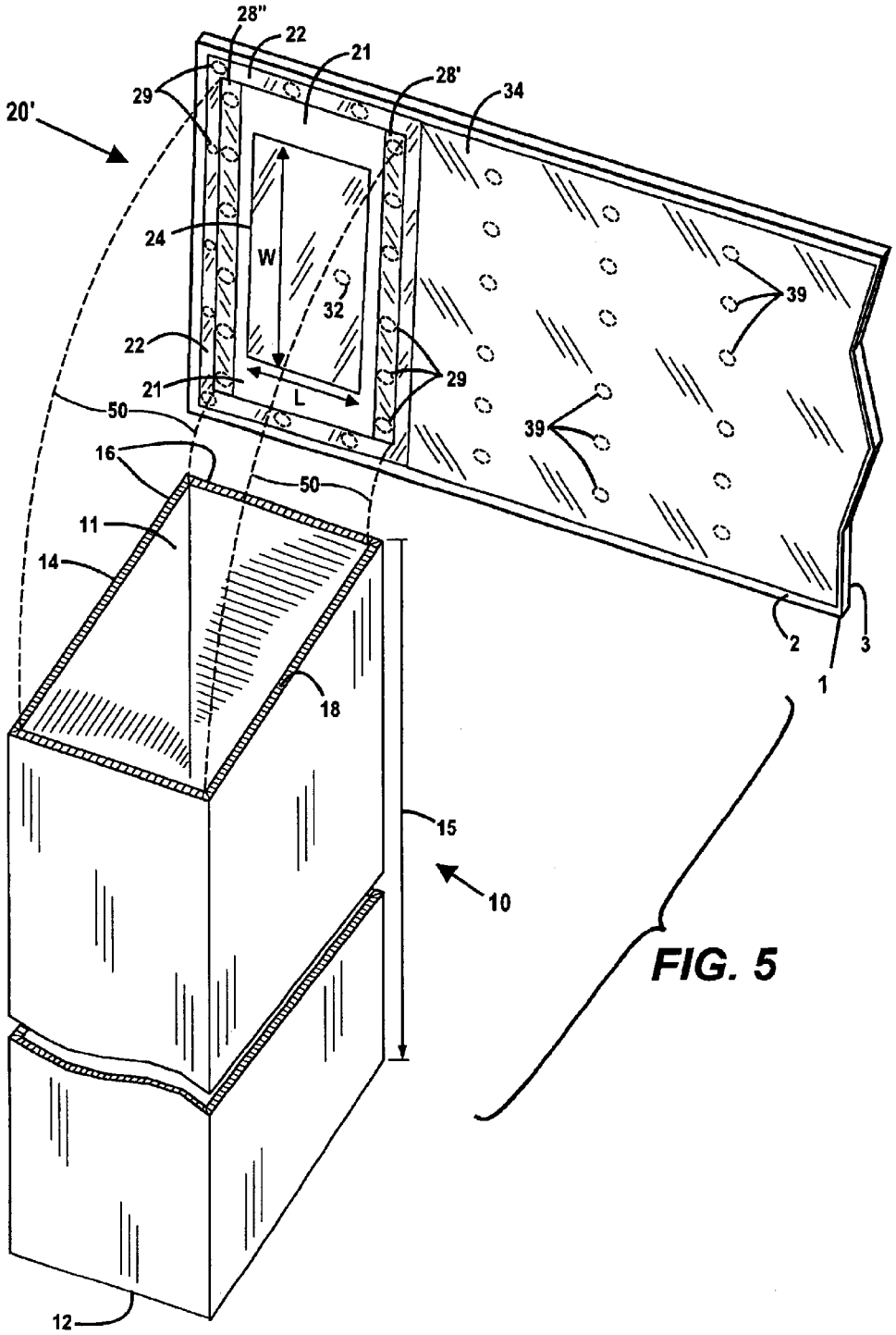
FIG. 5 shows a perspective view of a second exemplary coupling structure according to the present invention separated from an end of a waveguide.

FIG. 5 shows an embodiment 20 ' where two capacitive diaphragms 28' and 28" have been used in place of a single diaphragm 28. Embodiments 20 ' uses the following components of the embodiments 20 shown in FIGS. 1–4 as previously described; substrate 1 with major surfaces 2 and 3; first area 21; ground ring 22; patch antenna 24 with width W and length L; vias 29; ground 34, and vias 39. Embodiments 20' is attached to the same waveguide 10 as shown in FIGS. 1 and 2, with the attachement being illustrated by dashed attachment lines 50. Waveguide 10 has first end 11, second end 12, housing 14, longitudinal dimension 15, walls 16, and lip 18, as previously described. The two diaphragms 28 ' and 28" of embodiments 20' are located on either side of the length of patch antenna 24, and antenna 24 has been shifted more toward the center of the first area defined by ground ring 22. In addition, the position of via 32 has been moved from being outside of the perimeter of patch antenna 24 (as fed to the antenna by a short trace), to being located within the antenna's perimeter. Otherwise, the rest of the components are identically placed. Diaphragm 28' is identical to diaphragm 28, except for a more narrow width and the lack of a rounded removed section to accommodate via 32, and diaphragm 28' may be a mirror image of diaphragm 28'. The variations described above for diaphragm 28 may be applied to diaphragms 28' and 28".

Tuning of Coupling Structure 20.

The frequency of operation, $f_{op}$, for coupling structure 20 can be selected by selecting the effective length $L_{eff}$ of the patch antenna. The effective length $L_{eff}$ is slightly larger than the actual length L of the patch, and the increased amount of $L_{eff}$ accounts for the fringing electric fields at the far ends (i.e., distal ends) of the patch. As is well known in the art, the frequency of operation $f_{op}$ has a corresponding free-space wavelength $\lambda_{op}$:$\lambda_{op}=c/f_{op}$ where c is the speed of light. For a given value of $f_{op}$, the effective length $L_{eff}$ is usually selected to be equal to the quantity:

$$L_{eff} = \frac{1}{2} \cdot \frac{\lambda_{op}}{\sqrt{\varepsilon_{r,eff}}},$$

where $\in_{r,eff}$ is the effective relative dielectric constant of substrate layer 1 as seen by patch antenna 24. (We note that for the purposes of using the above equation, the length dimension is the one where the electrical signal is fed to one side of the dimension, and the width dimension is the one where the electrical signal is fed at the center of the dimension.) The effective relative dielectric constant for the patch antenna is generally approximated by the following formula that is known to the art:

$$\epsilon_{r,eff} = 1 + 0.63 \cdot (\epsilon_r - 1) \cdot \left(\frac{W}{d_S}\right)^{0.1255} \quad \text{for } W > d_s,$$

where $\in_r$ is the effective dielectric constant of the material forming substrate 1, where W is the width of the patch antenna, where $d_S$ is the thickness of substrate 1, and where the formula is applicable for the case of $W>d_S$. For the embodiments we are considering, the width W will be much greater than the thickness $d_S$.

We now consider the case of computing a value of $L_{eff}$ for an operating frequency of $f_{op}$=76 GHz, a patch width W of approximately 2 mm, a substrate thickness $d_S$ of 0.1 mm, and a relative dielectric constant $\in_r$=3.0 for substrate 1. From these values, we find that the effective relative dielectric constant $\in_{r,eff}$=2.835, $\lambda_{op}$=3.945 mm, and $L_{eff}$=1.171 mm. We must now determine the extent of the fringing fields in order to compute the actual length L of the patch antenna from $L_{eff}$. The customary approach in the art for accounting for the fringing fields is to assume that the fringing fields extend a distance of one-half the substrate thickness, that is $0.5 \cdot d_S$, at each distal end (i.e., far end) of the antenna's length, which makes: $L_{eff} \approx L+d_S$, which is equivalent to: $L \approx L_{eff}-d_S$. The true effective extent and effect of the fringing fields can be better estimated by simulation with a 3-D electromagnetic simulator. We have done that, and found that the effective extent of the fringing fields for our constructed embodiment is around $0.675 \cdot d_S$, giving $L \approx L_{eff}-1.35 \cdot d_S$, and a value of L=1.171 mm−0.135 mm=1.036 mm.

Once a value of L is selected, impedance matching between the impedance of the planar transmission line and the impedance of the waveguide at the operating frequency $f_{op}$ can be achieved by the selection of the width W of patch antenna 24, and/or the selection of the dimensions of the capacitive diaphragm 28. As is known in the transmission line art, inductive and/or capacitive reactances can be added at the junction of two transmission lines of different characteristic impedances in order to provide a matching of the impedances at a specific operating frequency, and for small frequency range thereabout. If the impedances are not well matched at the specific frequency, a significant portion of the signal 4 transmitted on trace 30 will be reflected back to MMIC 8, leading to a low degree of transmission from MMIC 8 to waveguide 10. A good matching of impedances at the specific frequency is demonstrated by a low amount reflection and a high degree of transmission.

In our case, we may view waveguide 10 as having a characteristic impedance which we want to match to the characteristic impedance of trace 30. (Methods of determining the characteristic impedance of a waveguide for a desired mode of excitation are well known to the art, as are methods for determining the characteristic impedance of electrical traces.) We then add capacitive reactance at the effective junction between trace 30 and the first end 11 of waveguide 10 to improve the matching between the characteristic impedances. Capacitive diaphragm 28 adds a capacitive reactance to the effective junction point. Increasing the width and/or the area of the diaphragm increases the amount of capacitive reactance that is combined with the reactance of the patch antenna, and decreasing the width and/or area will decrease the amount of capacitive reactance.

One of ordinary skill in the art may use any one of several three-dimensional electromagnetic software simulation programs available on the market to simulate various dimensions of the capacitive diaphragm 28 to provide a desired level of impedance matching. In this way, diaphragm 28 may be used to improve the impedance matching between trace 30 and waveguide 10. As another approach, many of the three-dimensional simulation programs are capable of directly computing scattering parameters which are representative of the amount of signal reflected back to MMIC 8 and of the degree of transmission from MMIC 8 to waveguide 10. Several simulations may be conducted using different dimensions for patch antenna 24 and diaphragm 28 to determine a set of dimensions which provides a low amount of reflection (low magnitude of scattering parameter $S_{11}$) and a high degree of transmission (high magnitude of scattering parameter $S_{21}$) at the desired operating frequency. Usually, lowering scattering parameter $S_{11}$ will result in an increase in scattering parameter $S_{21}$, and therefore the search for appropriate dimensions is relatively simple.

Simulation Results

EXAMPLE 1

Figure 6:
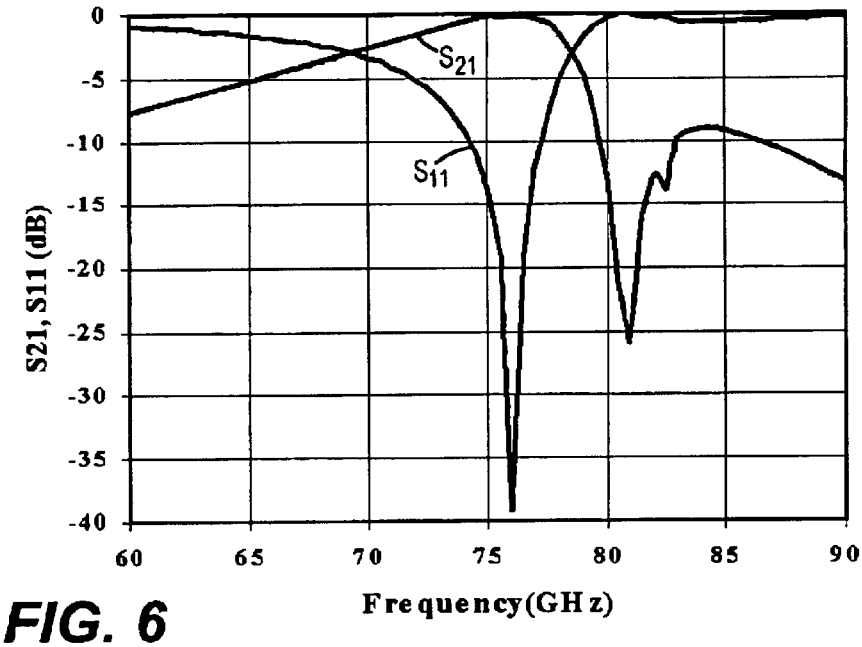
FIGS. 6 and 7 show plots of reflection and transmission coefficients for two exemplary embodiments according to the present invention.

FIG. 6 shows a plot of the magnitudes of simulated scattering parameters $S_{11}$ and $S_{21}$ for an exemplary coupling structure 20 constructed for an operating frequency of 76 GHz, with trace 30 configured as a 50-ohm microstrip line (additional ground planes 36 and 38 are not used). The magnitude of $S_{11}$ is proportional to the magnitude of the portion of signal 4 which is reflected from the waveguide back to MMIC 8 divided by the magnitude of signal 4 as initially generated by MMIC 8. The magnitude of $S_{21}$ is proportional to the magnitude of the wave transmitted through waveguide 10 from its first end divided by the magnitude of signal 4 as initially generated by MMIC 8. The magnitudes of parameters $S_{11}$ and $S_{21}$ range between 0 ($-\infty$ db) and 1.0 (0 dB), and are often given in units of decibels (dB). As a general rule, $S_{21}$ decreases as $S_{11}$ increases, and $S_{21}$ increases and $S_{11}$ decreases. A magnitude of $S_{11}$ near zero, and a magnitude of $S_{21}$ near 1 indicate a good impedance match. Referring to FIG. 6, it can be seen that at the operating frequency of 76 GHz the transmission scattering parameter $S_{21}$ is near 0 dB (which corresponds to 1.0), and the reflection scattering parameter S11 is close to −40 dB (which corresponds to $1\times10^{-4}$). Thus, the return loss at 76 GHz is substantially 40 dB. As can be seen in FIG. 6, there is a 15-dB return loss bandwidth of approximately 2 GHz centered about the operating frequency of 76 GHz.

The dimensions of the components of the present invention for the above exemplary embodiment are provided by Table I.

TABLE I

| | |
|---|---|
| Substrate layer 1 thickness | 0.1 mm |
| Relative dielectric Constant of substrate layer 1 | 3.0 |
| Dimensions of waveguide 10 | 3.10 mm by 1.55 mm |
| Strip width of ground ring 22 | 0.2 mm |
| Inside dimensions of ground ring 22 | 3.10 mm by 1.55 mm |
| Width W of patch antenna 24 | 2.13 mm |
| Length L of patch antenna 24 | 1.036 mm |
| Dimensions of capacitive diaphragm 28 | 3.10 mm by 0.3 mm |
| Strip width of trace 30 | 0.25 mm |

EXAMPLE 2

The device of Example 2 is similar to the device of Example 1 except for the following differences:

Two capacitive diaphragms 28' and 28" are used. They are disposed symmetrically on both sides of patch antenna 24, in the locations shown in FIG. 5. Each diaphragm 28', 28" is 3.1 mm long, and 0.150 mm wide.

Patch antenna 24 has the dimension of 1.88 mm by 1.036 mm.

Via 32 is located such that it makes contact to a point within the rectangular perimeter of patch antenna 24, the point being 200 $\mu$m from the perimeter of the patch antenna. Like the previous example, Via 32 is centered along the width dimension of patch antenna 24. The aperture diameter for via 32 is 200 $\mu$m.

Trace 30 has a tapered width over a 1.5 mm section of its length, the section being located near the end where it couples to via 32. Near MMIC 8, trace 30 has a width of 250 $\mu$m (which provides a 50 ohm characteristic impedance), and near via 32 it has a width of 400 $\mu$m.

Figure 7:
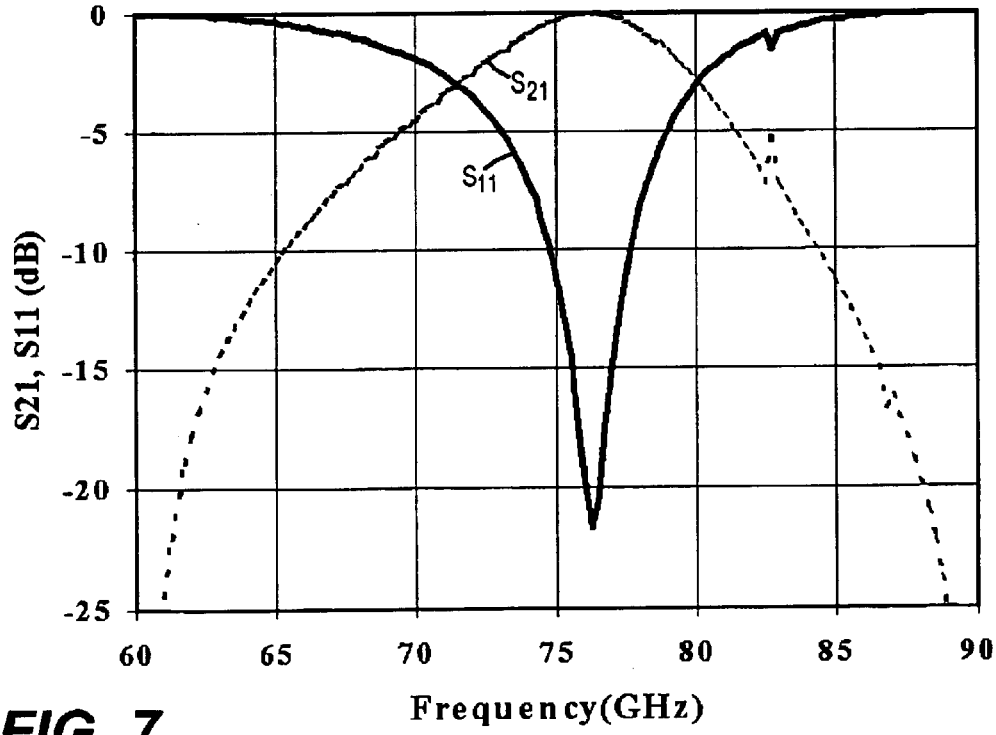

FIG. 7 shows a plot of the magnitudes of simulated scattering parameters $S_{11}$ and $S_{21}$ for the example 2 device constructed for an operating frequency of 76 GHz. From the figure it can be seen that at the operating frequency of 76 GHz the transmission scattering parameter S21 is near 0 dB (which corresponds to 1.0), and the reflection scattering parameter S11 is close to −22 dB (which corresponds to $3.2\times10^{-3}$). Thus, the return loss at 76 GHz is substantially 22 dB. As can be seen in FIG. 7, there is an 11-dB return loss bandwidth of approximately 2 GHz centered about the operating frequency of 76 GHz.

Accordingly, it may be appreciated that the coupling structures according to the present invention can provide high transmission efficiencies from planar transmission lines to waveguides with very low return losses within a desired transmission bandwidth. In addition, the components of the coupling structure may all be formed on the major surfaces of a substrate, which provides a very compact coupling structure that is very inexpensive to construct with present-day circuit board construction processes, and which can be readily attached to an end of a waveguide without the need for structural modifications. As a result, the manufacturing and packaging costs of the coupling structure are significantly reduced over those of prior art coupling structures.

The present invention enables the achievement of a completely planar coupling structure for coupling between planar transmission lines and waveguide.

Exemplary Applications for the Present Invention

The present invention may be used in a myriad of microwave signal feeding arrangements where an antenna feeds a signal into a waveguide, and where an antenna receives a signal from a waveguide. More particularly, the present invention may be used by instrumentation equipment which have waveguide-to-MMIC interfaces.

The present invention is particularly useful in automotive radar applications, and more specifically automotive collision detection systems. Here, the present invention is capable of providing a planar antenna coupled to a waveguide with very low transition loss and very low reflection loss.

While the present invention has been particularly described with respect to the illustrated embodiments, it will be appreciated that various alterations, modifications and adaptations may be made based on the present disclosure, and are intended to be within the scope of the present invention. While the invention has been described in connection with what is presently considered to be the most practical and preferred embodiments, it is to be understood that the present invention is not limited to the disclosed embodiments but, on the contrary, is intended to cover various modifications and equivalent arrangements included within the scope of the appended claims.

What is claimed is:

1. A structure for coupling an electrical signal on a substrate to a waveguide, the substrate having a substrate layer with a first major surface and a second major surface, the waveguide having a first end, a second end, and a housing disposed between the first and second ends, the housing having one or more walls and defining a longitudinal dimension between the first and second ends along which electromagnetic waves propagate, the one or more walls forming a lip at the first end, the structure comprising:

a ground ring located on the first major surface of the substrate layer and adapted for contact with the lip at the waveguide's first end, said ground ring enclosing a first area;

a patch antenna disposed on the first major surface of the substrate layer or within the substrate layer, and located within or below said first area;

a ground plane disposed on the second major surface of the substrate layer and located opposite to at least said first area;

a conductive trace disposed on the second major surface of the substrate layer or within the substrate layer; and a conductive via disposed in the substrate layer, said conductive via being electrically coupled to said patch antenna and to said conductive trace.

2. The structure of claim 1 wherein said ground plane is further located opposite to said ground ring.

3. The structure of claim 1 wherein said ground ring comprises a portion that is opposite to a portion of said conductive trace.

4. The structure of claim 1 wherein said ground ring is electrically coupled to said ground plane.

5. The structure of claim 4 further comprising a conductive via disposed in said substrate layer, said conductive via being electrically coupled to said ground ring and to said ground plane.

6. The structure of claim 1 further comprising a capacitive diaphragm disposed on the first major surface of the substrate layer or within the substrate layer, and located between said patch antenna and said ground ring, said capacitive diaphragm comprising conductive material.

7. The structure of claim 6, wherein said conductive trace has a first portion overlying a portion of said patch antenna, a second portion overlying a portion of said capacitive diaphragm, and a third portion overlying a portion of said ground ring.

8. The structure of claim 6, wherein said capacitive diaphragm is electrically coupled to said ground ring.

9. The structure of claim 8 wherein said ground ring and said capacitive diaphragm comprise conductive material; and wherein said structure further comprises a gap between the patch antenna and the conductive material of the ground ring and capacitive diaphragm, said gap having a non-uniform width.

10. The structure of claim 2 further comprising:

a first spacing distance between said patch antenna and said capacitive diaphragm; and a second spacing distance between said patch antenna and said ground ring; and wherein said first and second spacing distances are unequal.

11. A structure for coupling an electrical signal on a substrate to a waveguide, the substrate having substrate layer with a first major surface and a second major surface, the waveguide having a first end, a second end, and a housing disposed between the first and second ends, the housing having one or more walls and defining a longitudinal dimension between the first and second ends along which electromagnetic waves propagate, the one or more walls defining a lip at the first end, the structure comprising:

a ground ring comprising conductive material and located on the first major surface of the substrate layer and adapted for contact with the lip at the first end of the waveguide, said ground ring enclosing a first area;

a patch antenna disposed on the first major surface of the substrate layer or within the substrate layer between the first and second major surfaces of the substrate layer, and located within or below said first area;

a capacitive diaphragm comprising conductive material and disposed on the first major surface of the substrate layer or within the substrate layer between the first and second major surfaces of the substrate layer, and located between said patch antenna and said ground ring; and a gap between the patch antenna and the conductive material of the ground ring and capacitive diaphragm, said gap having a non-uniform width.

12. The structure of claim 11 further comprising a conductive trace disposed on the second major surface of the substrate layer or within the substrate layer between the first and second major surfaces of the substrate layer, said conductive trace having a first portion overlying a portion of said patch antenna, a second portion overlying a portion of said capacitive diaphragm, and a third portion overlying a portion of said ground ring; and a conductive via disposed in the substrate layer, said conductive via being electrically coupled to said patch antenna and to said conductive trace.

13. The structure of claim 11 further comprising:

a first spacing distance between said patch antenna and said capacitive diaphragm; and a second spacing distance between said patch antenna and said ground ring; and wherein said first and second spacing distances are unequal.

14. The structure of claim 11 wherein said capacitive diaphragm is electrically coupled to said ground ring.

15. A structure for coupling an electrical signal on a substrate to a waveguide, the substrate having a substrate layer with a first major surface and a second major surface, the waveguide having a first end, a second end, and a housing disposed between the first and second ends, the housing having one or more walls and defining a longitudinal dimension between the first and second ends along which electromagnetic waves may propagate, the one or more walls defining a lip at the first end, the structure comprising:

a closed-loop strip of conductive material located on the first major surface of the substrate layer, said strip of conductive material comprising a shape which is a substantial mirror image of the lip at the first end of the waveguide;

a first area disposed on the first major surface of the substrate layer and disposed within said closed-loop strip of conductive material;

a first conductive pad disposed on the first major surface of the substrate layer or within the substrate layer between the first and second major surfaces of the substrate layer, and further located within or below said first area, said conductive pad being separated from said closed-loop strip of conductive material;

a second area disposed on the second major surface of the substrate layer and located opposite to at least said first area;

a first layer of conductive material disposed on the second major surface of the substrate layer and located within said second area; and a second conductive pad disposed on the first major surface of the substrate layer or within the substrate layer between the first and second major surfaces of the substrate layer, and further located between said first conductive pad and said closed-loop strip of conductive material.

16. The structure of claim 15 wherein said closed-loop strip of conductive material is electrically coupled to said first layer of conductive material.

17. The structure of claim 16 further comprising a conductive via disposed through the substrate layer, said conductive via being electrically coupled to said closed-loop strip of conductive material and to said first layer of conductive material.

18. The structure of claim 15 wherein said first layer of conductive material is further located opposite to said closed-loop strip of conductive material.

19. The structure of claim 15 wherein a portion of said second pad of conductive material adjoins to a portion of said closed-loop strip of conductive material and is electrically coupled thereto.

20. The structure of claim 15 further comprising a conductive trace disposed on the second major surface of the substrate layer or within the substrate layer between the first and second major surfaces of the substrate layer, said conductive trace having a first portion overlying a portion of said first conductive pad, a second portion overlying a portion of said second conductive pad, and a third portion overlying a portion of said closed-loop strip of conductive material; and a conductive via disposed in the substrate layer, said conductive via being electrically coupled to said first conductive pad and to said conductive trace.

21. The structure of claim 15 further comprising a conductive trace disposed on the second major surface of the substrate layer or within the substrate layer between the first and second major surfaces of the substrate layer; and a conductive via disposed in the substrate layer, said conductive via being electrically coupled to the first conductive pad and to the conductive trace.

* * * * *